United States Patent [19]

Satoh et al.

[11] Patent Number: 4,866,892

[45] Date of Patent: Sep. 19, 1989

[54] EXTENSIBLE STRUCTURE

[75] Inventors: Shigeru Satoh; Kakuma Okazaki, both of Yokohama, Japan

[73] Assignee: Japan Aircraft Mfg. Co., Ltd., Yokohama, Japan

[21] Appl. No.: 172,600

[22] Filed: Mar. 24, 1988

[30] Foreign Application Priority Data

Mar. 31, 1987 [JP] Japan ..... 62-78683

[51] Int. Cl.[4] ..... E04H 12/20

[52] U.S. Cl. ..... 52/108; 52/632; 52/646

[58] Field of Search ..... 52/108–111, 52/632, 635, 645, 646; 135/103, 104; 182/41, 42, 152; 242/54 A

[56] References Cited

U.S. PATENT DOCUMENTS

| | | | |
|---|---|---|---|
| 2,864,389 | 12/1958 | Smith et al. | 135/104 X |
| 3,439,467 | 4/1969 | Partlow | 52/632 |
| 3,474,579 | 10/1969 | Kieser | 52/108 |
| 3,482,279 | 12/1969 | Webb | 52/108 |
| 4,334,391 | 6/1982 | Hedgepeth et al. | 52/108 |
| 4,532,742 | 8/1985 | Miura | 52/108 |
| 4,662,130 | 5/1987 | Muira et al. | 52/108 |
| 4,667,451 | 5/1987 | Onoda | 52/646 |

*Primary Examiner*—David A. Scherbel
*Assistant Examiner*—Anthony W. Williams
*Attorney, Agent, or Firm*—Frishauf, Holtz, Goodman & Woodward

[57] ABSTRACT

An extensible structure comprising five or more longerons which can be resiliently deformed like a coil, a plurality of batten members arranged at certain intervals in the axial direction of the longerons to connect the longerons to one another, and two chords diagonally stretched on a plane formed a four connected points where the two longerons with at least one longeron interposed between them are connected by the two batten members adjacent in the axial direction of the longerons.

4 Claims, 13 Drawing Sheets

EXTENSIBLE STRUCTURE

BACKGROUND OF THE INVENTION

1. Field of the Invention

The present invention relates to an extensible structure and more particularly, it relates to an improvement of the extensible structure wherein a plurality of longerons which can be resiliently deformed like a coil are connected to one another by batten members, and chords are diagonally stretched between connected points of the adjacent longerons and a batten member and connected points of these longerons and an adjacent batten member, and wherein when the longerons are deployed like a straight line, a truss structure can be formed, while when the longerons are deformed like a coil, the structure can be collapsed.

2. Description of the Related Art

A structure of this kind is used for a space station as the support mast for solar batteries, and for other space craft. It can be used on the ground as an antenna support which can be easily assembled in an emergency, and for other uses also.

This structure includes a plurality of bendable longerons, a plurality of batten members for connecting these longerons to one another, and chords stretched between adjacent longerons and between adjacent batten members. This extensible structure is disclosed in U.S. Pat. Nos. 3,486,279 (Mauch) and 4,334,391 (Hedgepeth et al). They have rod-like batten members, and adjacent longerons are connected to each other by a batten member. U.S. Pat. Nos. 4,532,742 (Miura et al) and 4,662,130 (Miura) also relate to this extensible structure. They have star-like batten members each having plural arms radially projected from the center of the batten member, and front ends of these arms are attached to the longerons.

FIGS. 1 through 3 show one of these conventional extensible structures. This structure has three longerons and resiliently twistable and deformable batten members. FIG. 1 shows the structure extended, FIG. 2 shows it on the way to its being extended, and FIG. 3 shows it collapsed. It has disk-like end plates 1 and 2. One end of these three longerons 3, respectively, is attached to end plate 1 through hinges 4, while the other end thereof is attached to end plate 2 through hinges (not shown). The ends of longerons 3 are connected to end plates 1 and 2 through hinges in such a manner that longerons 3 can be freely rotated in the circumferential direction of these end plates 1 and 2. Longerons 3 are connected to one another by a plurality of batten members 5. Batten members 5 are arranged in the axial direction of longerons 3 with a certain interval interposed between adjacent ones. Each of batten members 5 has three arms radially projected from the center thereof, and the free ends of these arms are attached to longerons 3. When the structure is extended as shown in FIG. 1, these arms are twisted and deformed, while when it is collapsed as shown in FIG. 3, they become flat. Two chords 6 are diagonally stretched, crossing each other, between four connected points of two adjacent longerons and two batten members adjacent in the axial direction of longerons 3. Each of batten members 5 is provided with through-hole 8 in the center thereof and end plate 1 is also provided with through-hole 9 in the center thereof. Cable 7 is passed through these through-holes 8 and 9 and its foremost end is attached to the center of end plate 2. A take-up drum (not shown) is arranged under end plate 1 and the cable is wound round this take-up drum.

When the take-up drum winds up cable 7 in this extensible structure, longerons are resiliently deformed like a coil as shown in FIG. 3 and the structure can be collapsed to have an extremely small volume relative to its extended state. When the take-up drum feeds cable 7, longerons 3 are extended like a straight line by their resilient force to finally cause the structure to be erected like a straight line as shown in FIG. 1. When the structure is in the extended state shown in FIG. 1, each of chords 6 is stretched by a certain pulling force to form a truss framing, thereby enhancing the strength and stiffness of this structure.

In the case of this structure, however, each one of longerons 3 must be resiliently bendable. When the strength and stiffness of this structure are to be made high, however, the number of these longerons 3 must be increased. When the number of these longerons 3 is increased, however, the interval between adjacent ones of these longerons 3 becomes small. When the interval becomes small, the shape of a rectangle formed by four connected points between two adjacent longerons and two batten members adjacent in the axial direction of the longerons is made to have two sides long in the vertical direction of the longerons and two sides short in the horizontal direction thereof. When the diagonal chords are stretched to have an angle of 45° relative to the longeron or batten member, they are usually the most effective and it is therefore practically preferable that they are stretched relative to the longeron or batten member within a range of 45°±15°. When the shape of the plane over which these chords are stretched or the shape of the rectangle formed by four connected points of the two adjacent longerons and two batten members adjacent in the axial direction of the longerons is made slender, the angle formed by the chord and the longeron falls outside the above-mentioned range. As the result, the stiffness and strength of this structure are lowered, and particularly its stiffness becomes low. In order to eliminate this drawback, it is needed that the interval of two batten members adjacent in the axial direction of the longerons is made small, corresponding to the shortened interval of the two adjacent longerons, and that the shape of the rectangular plane formed by four connected points is made more and more similar to a square. When they are arranged like this, however, the number of the batten members becomes too large and the structure becomes complicated and, thus heavy. Further, when the number of the batten members is made large in the case where the arms of the batten members are twisted and deformed as described above, the pulling load of cable 7 at the time when the structure is to be collapsed to have an extremely small volume relative to its extended state must be made large, thereby making it necessary to make the strength of this cable and that of its related mechanisms high. This causes the structure to be even heavier.

SUMMARY OF THE INVENTION

The present invention is, therefore intended to eliminate the above-mentioned drawbacks and the object of the present invention is to provide an extendable structure that is lightweight and easily constructed but having a high stiffness, particularly a high twisting stiffness.

According to the present invention, two chords are diagonally stretched, crossing each other, between four connected points of two longerons with at least a longeron interposed between them and two batten members adjacent in the axial direction of the longerons. In a case where the number of longerons used is six, for example, and when they are successively called first to sixth longerons in the circumferential direction, the two chords are diagonally stretched, crossing each other, between two points and between the other two points where the first and third longerons, for example, are connected to two batten members adjacent in the axial direction of the longerons. The chords are similarly stretched between the third and fifth longerons, between the fifth and first longerons, between the second and fourth longerons, and between the fourth and sixth longerons.

The interval between the first and the third longeron is larger than that between the first and the second longeron which are adjacent to each other. It is not, therefore needed that the interval between the adjacent batten members is made unnecessarily small. It is thus made unnecessary to make the number of the batten members unnecessarily large. The structure of the present invention can be thus made simple in construction and lightweight while having a sufficient twisting stiffness. The present invention is applied to the structure having five or more longerons. Because two longerons with a longeron interposed between them mean these two longerons themselves in the case of three longerons used, and because the chords do not serve to enhance the twisting stiffness when they are stretched between the two longerons with a longeron interposed between them in the case of four longerons used.

DETAILED DESCRIPTION OF THE PREFERRED EMBODIMENTS

Figure 1:
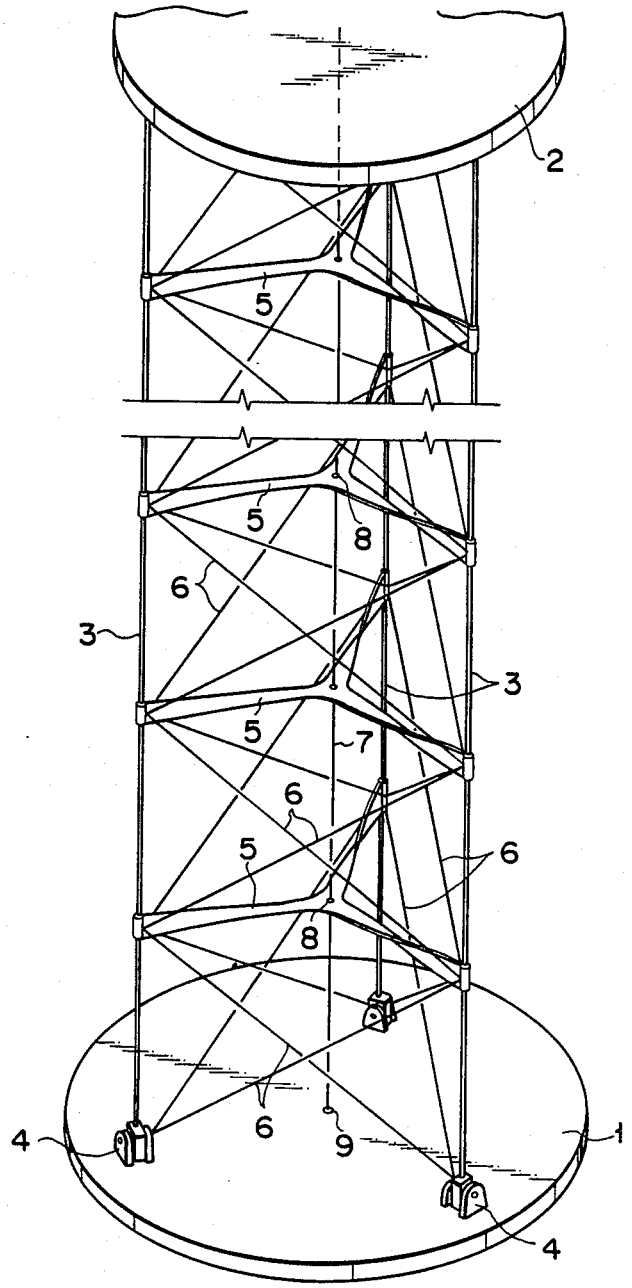
FIG. 1 PRIOR ART
FIG. 1 is a perspective view showing the conventional extensible structure extended.
Figure 2:
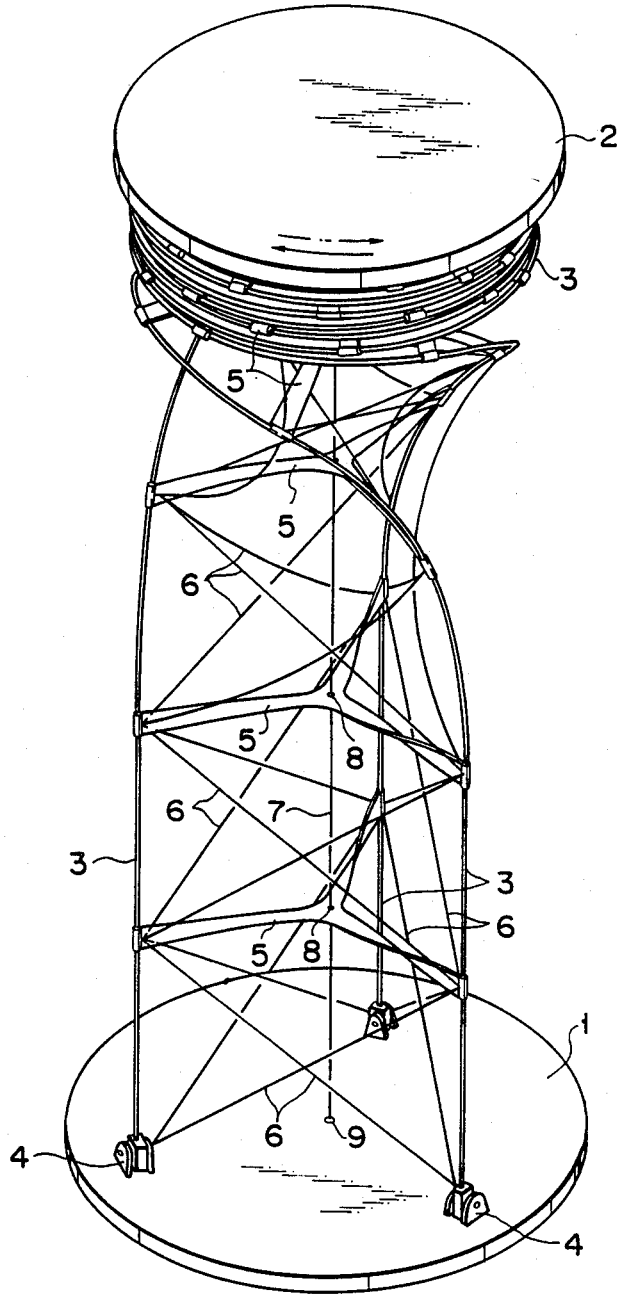
FIG. 2 PRIOR ART
FIG. 2 is a perspective view showing the structure of FIG. 1 partially extended.
Figure 3:
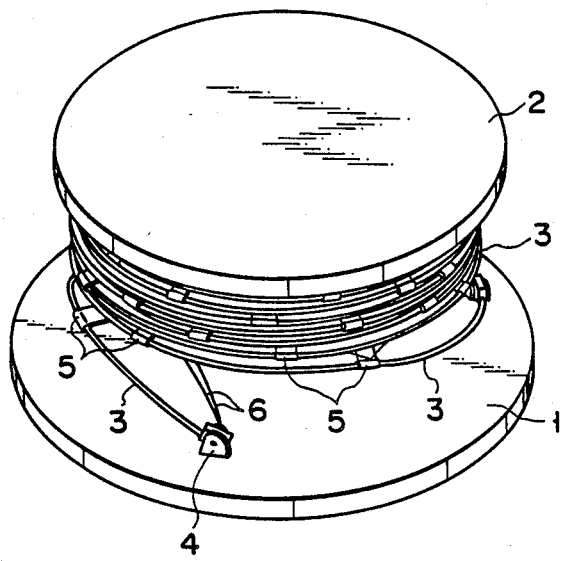
FIG. 3 PRIOR ART
FIG. 3 is a perspective view showing the structure of FIG. 1 a collapsed condition.

FIGS. 4 through 7 show a first embodiment of the present invention, which is an extensible structure provided with six longerons. This structure is also provided with a pair of disk-like end plates 11 and 12. Six longerons 13, equal in length, are arranged between these end plates. These longerons 13 are made of synthetic resin such as epoxy resin reinforced by glass or carbon fibers, and can therefore be resiliently deformed to the shape of a coil. The first to sixth longerons are arranged on end plates 11 and 12 with an equal interval being interposed between the adjacent ones in the circumferential direction of end plates 11 and 12. One end of each longeron 13 is attached, so as to be freely rotatable, to end plate 11 by hinges 14, which are arranged along the circumferential rim and in the circumferential direction of end plate 11 with an equal interval being interposed between the adjacent hinges, while the other end of each longeron 13 is also attached to end plate 12 by means of the same hinges (not shown). Longerons 13 are connected to one another by a plurality of batten members 15, which are arranged in the axial direction of longerons 13 with a certain interval being interposed between adjacent batten members 15. Batten members 15 are made of fiber-reinforced synthetic resin or the like, and each of them has six arms 15*a* which are radially projected relative to their corresponding longerons. The free ends of these arms 15*a* are connected to their corresponding longerons 13. Each of arms 15*a* is formed to have an I- or H-shaped section and also to have a relatively high bending stiffness but a relatively low twisting stiffness.

Two chords 16 are diagonally stretched by a certain tensile force along diagonal lines on a rectangular plane formed by four connected points between two longerons 13, separated by one longeron interposed between and arms 15*a* of two batten members adjacent in the axial direction of longerons 13. These chords 16 are cables, wires or the like made of flexible fibers which have a high tensile strength. It will now be more concretely described as to how these chords 16 are arranged. It is assumed that the first to sixth longerons are successively arranged between the end plates in the circumferential direction thereof. Two chords 16 are diagonally stretched on the rectangular plane whose corner points are those four connected points where the first and third longerons 13 by the second longeron interposed between them, separated first and are connected to arms 15*a* of two batten members 15 adjacent to each other in the axial direction of the longerons. Similarly, two chords 16 are diagonally stretched between the third and the fifth longerons, between the fifth and the first longerons, between the second and the fourth longerons, between the fourth and the sixth longerons, and between the sixth and the second longerons, respectively.

Each of batten members 15 is provided with through-hole 18 in the center thereof, and end plate 11 is also provided with through-hole 19 in the center thereof. Cable 17 is passed through these through-holes 18 nd 19, and one end of cable 17 is attached to the center of end plate 12. A winding drum (not shown), which is driven by a motor or the like, is located under end plate 11, and cable 17 is wound around this winding drum.

Figure 4:
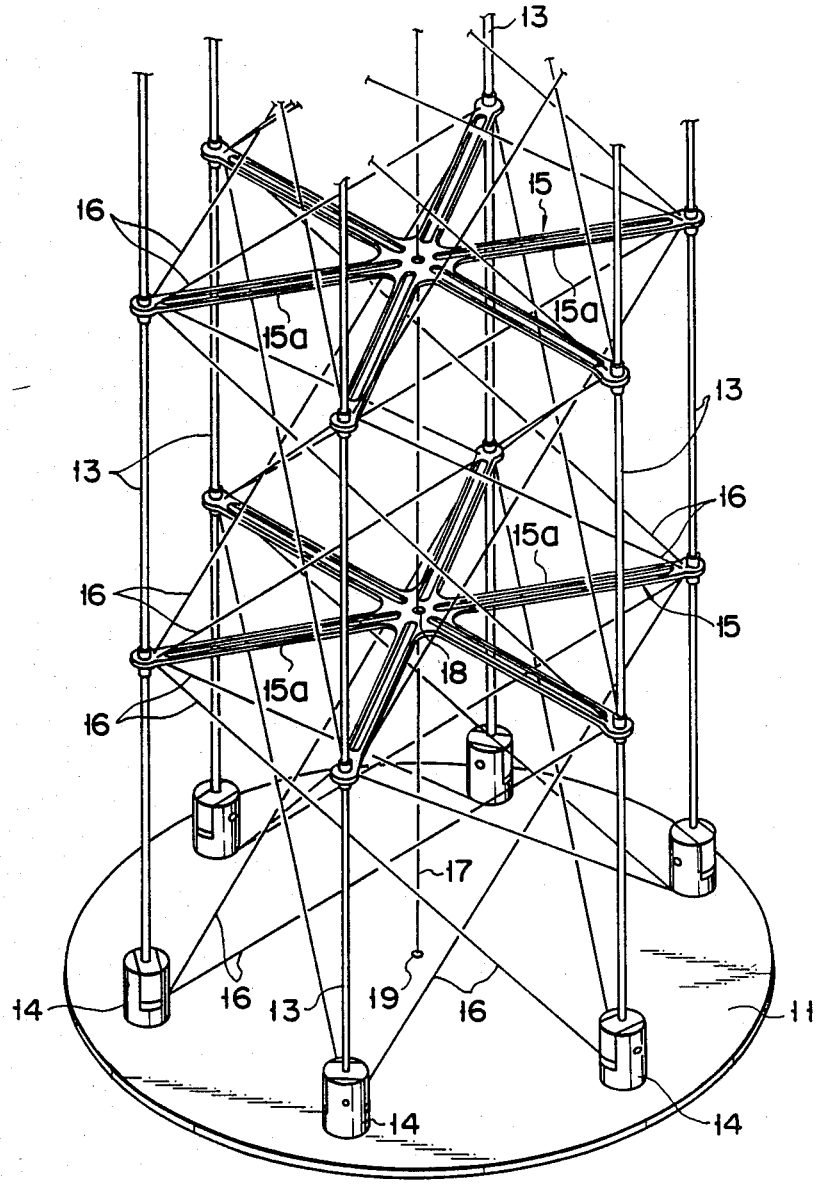
FIG. 4 is a perspective view showing a first example of the extensible structure according to the present invention in an extended condition, such structure having six longerons.
Figure 5:
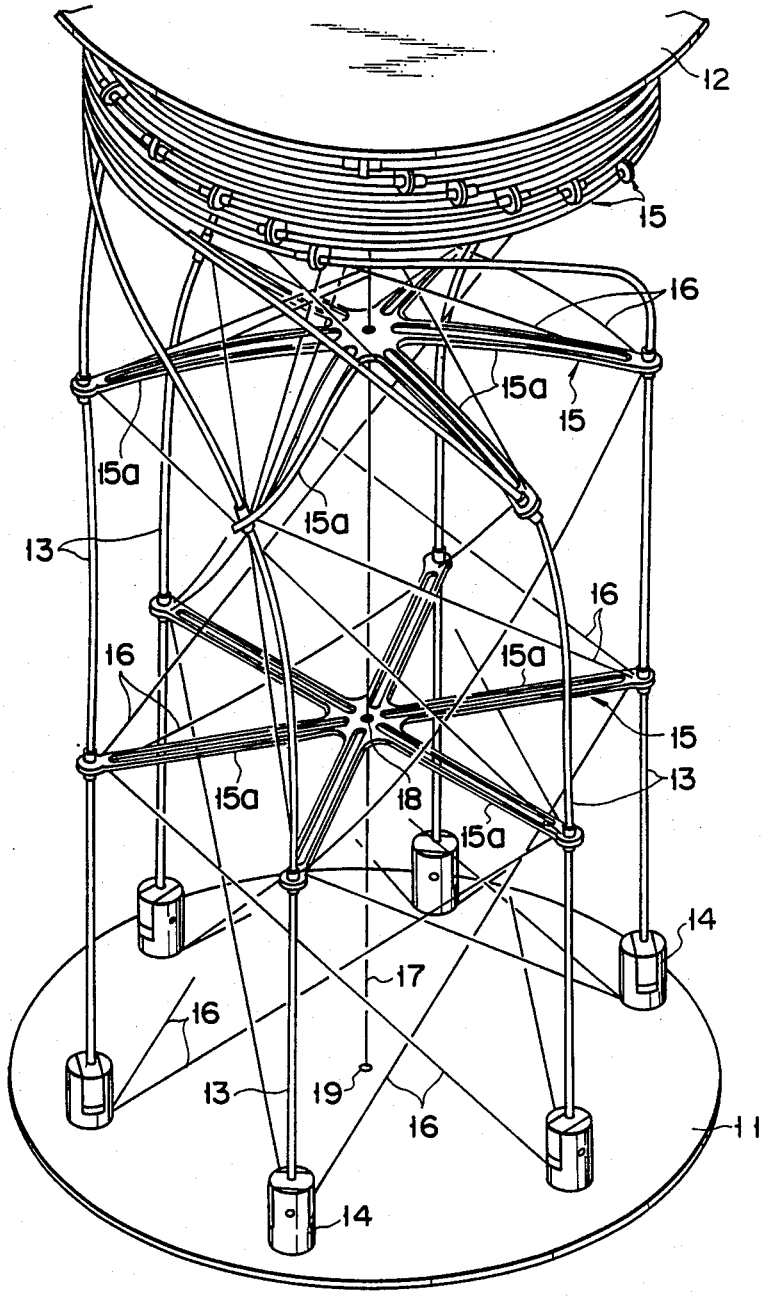
FIG. 5 is a perspective view showing the structure of FIG. 4 partially extended.
Figure 6:
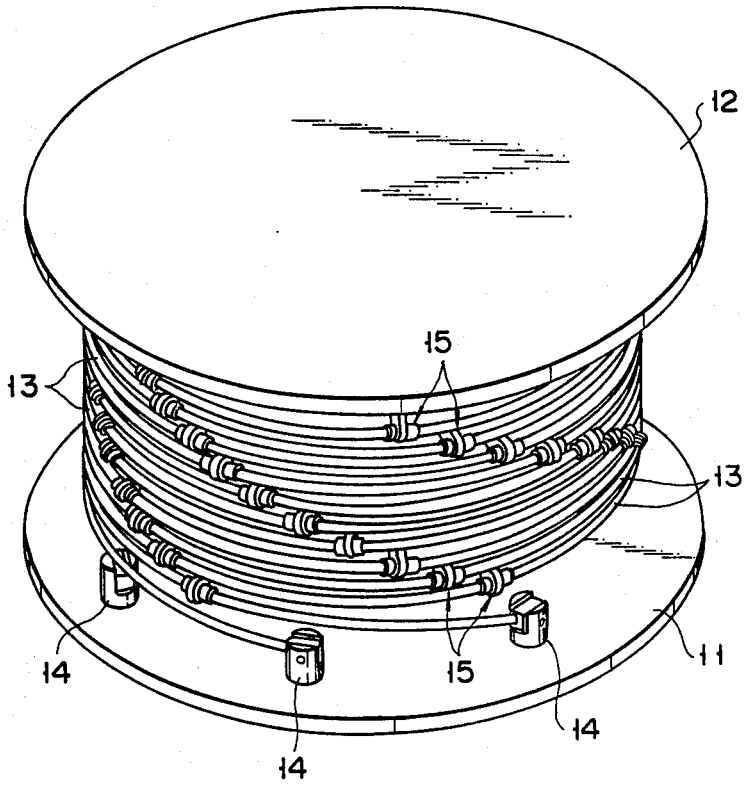
FIG. 6 is a perspective view showing the structure of FIG. 4 completely collapsed.
Figure 7:
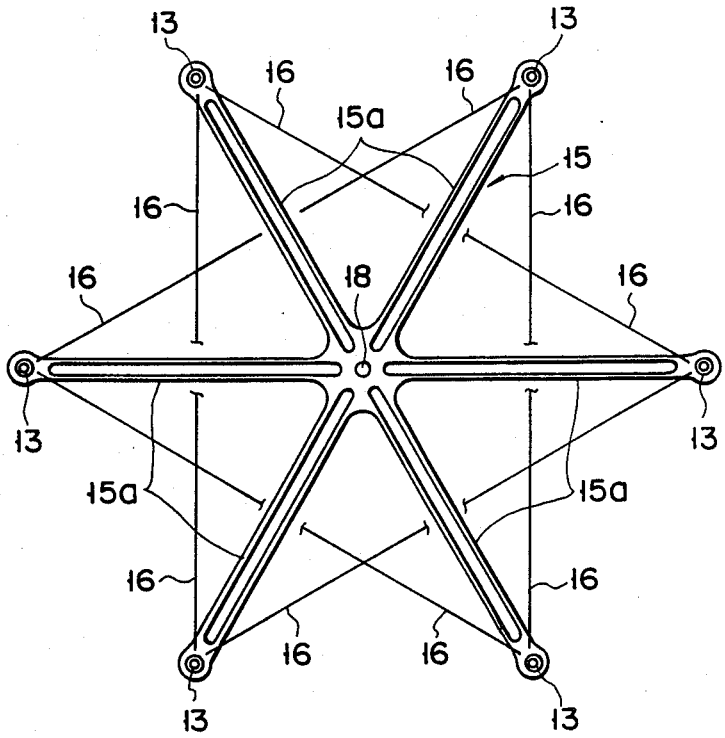
FIG. 7 is a plan view showing an arrangement of chords in the structure of FIG. 4.

When cable 17 is wound by the winding drum in this structure, longerons 13 are successively deformed so as to assume the shape of a coil, starting from their top and coiling downward as shown in FIG. 5, and formed similar to those in the case of the conventional extensible structure. When longerons 13 are deformed to the shape of a coil in this case, the free ends of arms 15*a* of batten members 15 are turned by about 90°, but this turning of the free end is made possible by the fact that the intermediate of arm 15*a* is twisted. Finally, all of longerons 13 are deformed to a collapsed coil shape so as to resemble a compressed coil as shown in FIG. 6. The extensible structure is stored and transported when it is in this collapsed state. The tension of the stretched chords 16 is slackened, and they are housed inside the collapsed longerons like a coil in this case. When the winding drum is turned to feed cable 17 so as to extend this structure, the longerons are successively extended in a straight line, as shown in FIG. 5, by the resilience of arms 15*a* of batten members 15 and of longerons 13 which finally form the structure resembling a straight line as shown in FIG. 4. Each of chords 16 is stretched by a certain tension in this case.

Chords 16 are stretched between two longerons 13 with a longeron interposed between them in this structure, and this therefore makes it possible for the interval between adjacent batten members 15 to be large. The interval between the first and the third longeron, for example, is about 1.73 times that of the interval between the two adjacent longerons or between the first and the second longeron. When it is imagined that the shape of a rectangle formed by the four connecting points of these two longerons and the two batten members is made similar to a square, and that each of chords 16 is stretched at an angle of 45° relative to the longeron or batten member, therefore, the interval between the adjacent batten members can be made about 1.73 times as compared with the case where the chords are stretched between adjacent longerons. It is, therefore not necessary to increase the number of batten members. The structure can be thus made simple in construction and light in weight.

Figure 8:
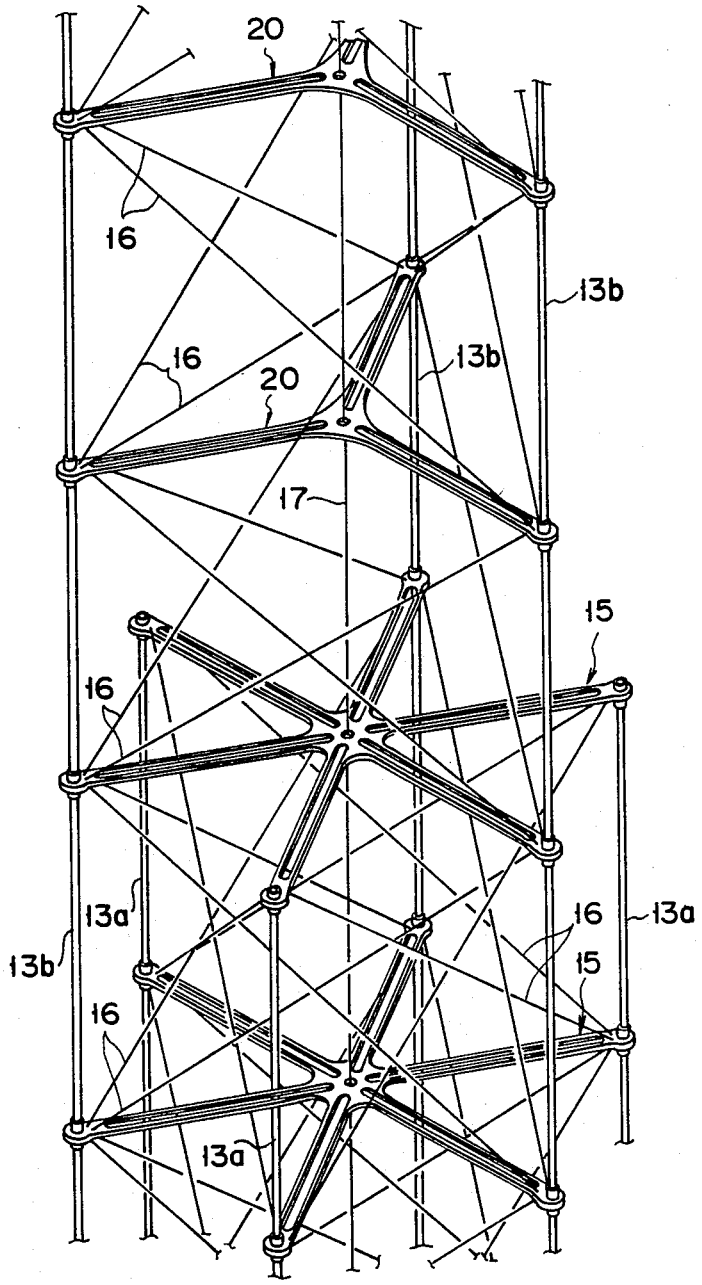
FIG. 8 is a perspective view showing a second embodiment of the present invention.

FIG. 8 shows a second embodiment of the present invention. In this embodiment, the end plates and the relating portions have the same structures as in the first embodiment mentioned above. Hence, only an intermediate portion of the second embodiment is shown in FIG. 8. The structure of the second embodiment is provided with six longerons as is that of the first embodiment. However, in the second embodiment, three longerons 13*a* are shorter than the remaining three longerons 13*b*. The longer three longerons 13*b* extend over and the entire length of the structure, and both ends thereof are attached to the end plates in the same manner as in the first embodiment. The shorter three longerons 13*a* are provided in the lower portion of this structure, where only the lower ends thereof are attached to the lower end plate in the same manner as in the first embodiment, and the upper ends thereof only reach to an intermediate point of the structure. These longer longerons 13*b* and shorter longerons 13*a* are disposed alternately: one shorter longeron 13*a* disposed between two longer longerons 13*b*, and one longer longeron 13*b* disposed between two shorter longerons 13*a*. In the lower longerons 13*b* and the three shorter longerons 13*a* are disposed, the six longerons are connected to one another by batten members 15 each having six arms, keeping a predetermined distance therebetween, and chords 16 are stretched in the same manner as in the first embodiment. In the upper portion of the structure, where only the three longer longerons as disposed, the three longerons are connected to one another by batten members 20 each having three arms, keeping a predetermined distance therebetween. A pair of chords 16 is diagonally stretched on the rectangular plane whose center points are the four connecting points where the two adjacent longerons 13*b* are connected to the arms of batten members 20 adjacent to each other in the axial direction of the longerons. The structure according to the second embodiment, as thus arranged, is advantageous when the load supported by the structure is not uniform in the axial direction of the longerons. For example, when the load supported by the structure in the lower portion is greater than that in the upper portion, the weight of the entire structure can be reduced by the structure of the second embodiment.

Figure 9:
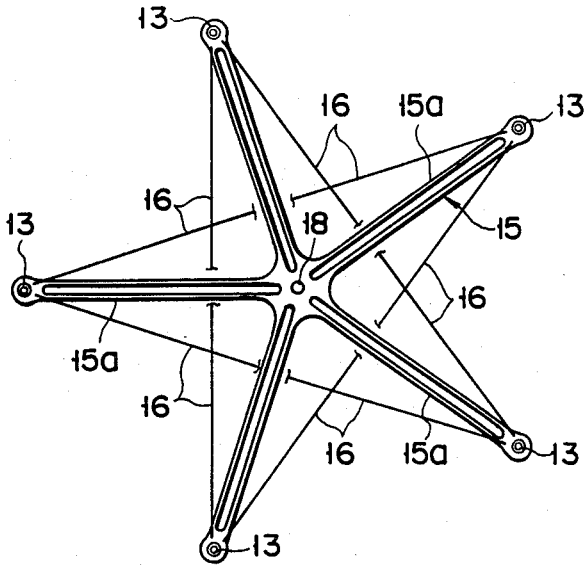
FIG. 9 is a plan view showing an arrangement of chords in a third embodiment of the present invention.

FIG. 9 shows a third embodiment of the present invention. This structure includes five longerons 13, wherein the cords 16 are stretched between the first and the third longeron, between the third and the fifth longeron, between the fifth and the second longeron, between the second and the fourth longeron, and between the fourth and the first longeron, respectively.

Figure 10:
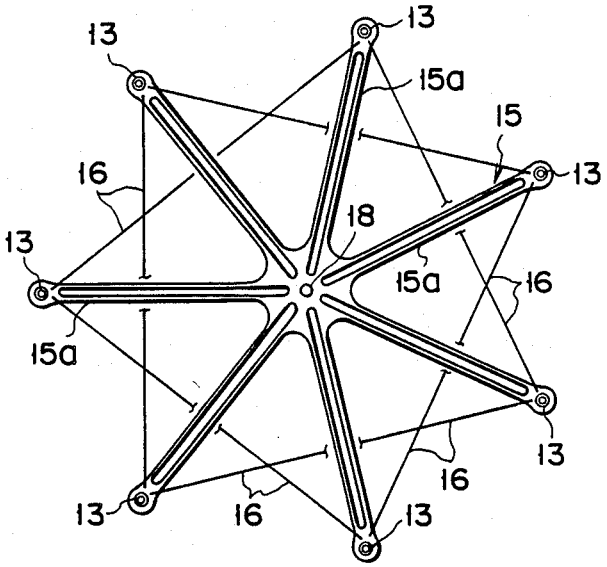
FIG. 10 is a plan view showing an arrangement of chords in a fourth embodiment of the present invention.

FIG. 10 shows a fourth embodiment of the present invention, which includes seven longerons 13. Chords 16 are stretched between the first and the third longeron, between the third and the fifth longeron, between the fifth and the seventh longeron, between the seventh and the second longeron, between the second and the fourth longeron, between the fourth and the sixth longeron and between the sixth and the first longeron, respectively.

Figure 11:
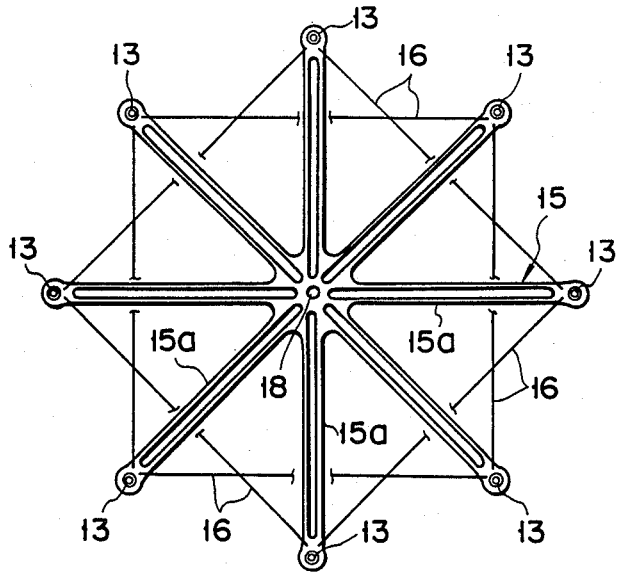
FIG. 11 is a plan view showing an arrangement of chords in a fifth embodiment of the present invention.

FIG. 11 shows a fifth embodiment of the present invention, which includes eight longerons 13. Chords 16 are stretched between the first and the third longeron, between the third and the fifth longeron, between the fifth and the seventh longeron, between the seventh and the first longeron, between the second and the fourth longeron, between the fourth and the sixth longeron, between the sixth and the eighth longeron and between the eighth and the second longeron, respectively.

Figure 12:
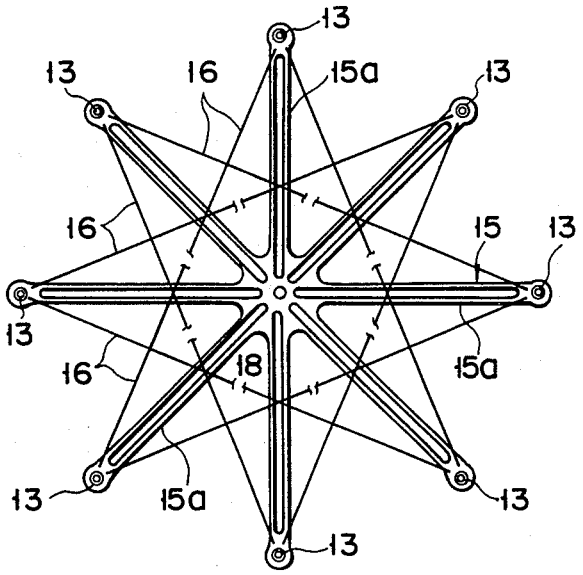
FIG. 12 is a plan view showing an arrangement of chords in a sixth embodiment of the present invention.

FIG. 12 shows a sixth embodiment of the present invention, which also includes eight longerons 13 and the chords are stretched between two longerons with two other longerons being interposed between them in this case. Namely, chords 16 are stretched between the first and the fourth longeron, between the fourth and the seventh longeron, between the seventh and the second longeron, between the second and the fifth longeron, between the fifth and the eighth longeron, between the eighth and the third longeron, between the third and the sixth longeron and between the sixth and the first longeron, respectively.

Figure 13:
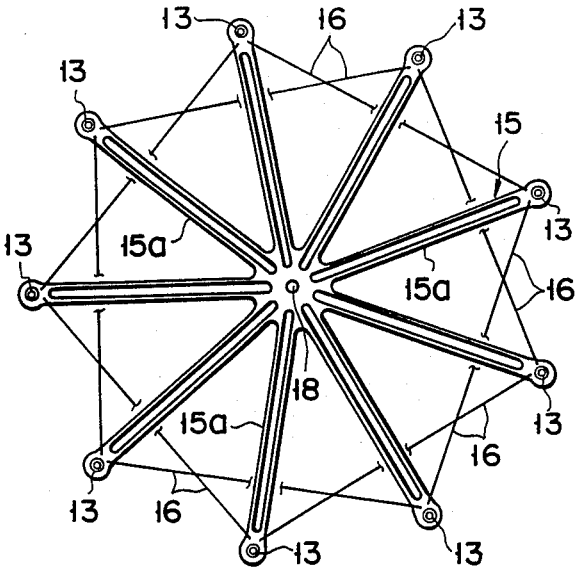
FIG. 13 is a plan view showing an arrangement of chords in a seventh embodiment of the present invention.
Figure 14:
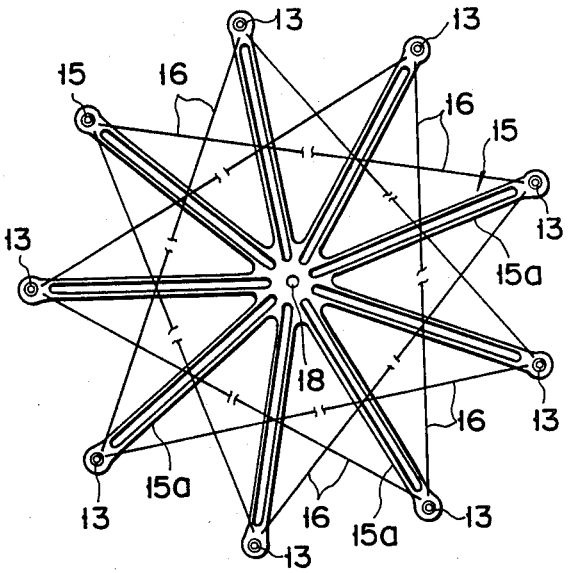
FIG. 14 is a plan view showing an arrangement of chords in an eighth embodiment of the present invention.

FIGS. 13 and 14 show seventh and eighth embodiments of the present invention. Both of these embodiments include nine longerons 13 and chords 16 are stretched between two longerons 13 with a longeron interposed between them in the case of the seventh embodiment shown in FIG. 13, while chords 16 are stretched between two longerons 13 with other two longerons interposed between them in the case of the eighth embodiment shown in FIG. 14. When the number of the longerons is increased like this, the chords can be stretched between the two longerons, keeping one, two or more longerons interposed between them.

Figure 15:
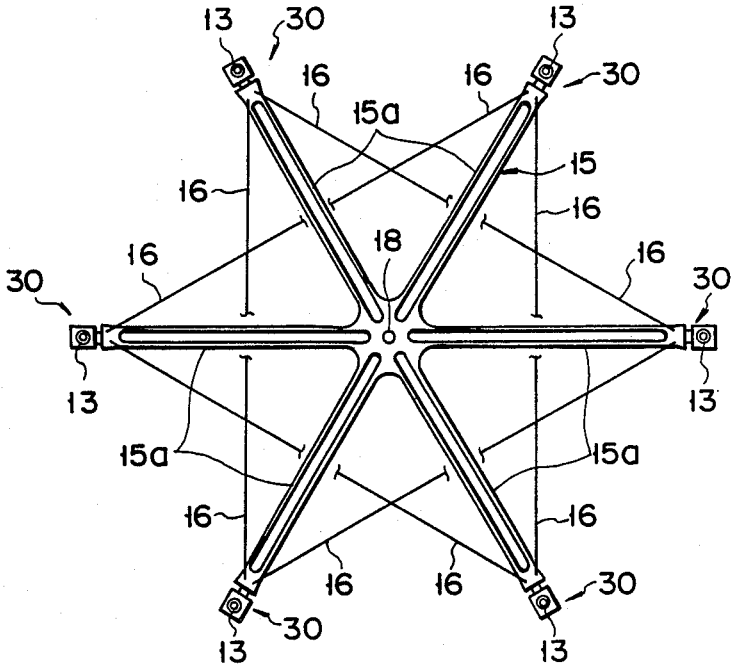
FIG. 15 is a plan view showing how longerons are connected to batten members in a ninth embodiment of the present invention.

FIG. 15 shows a ninth embodiment of the present invention wherein longerons 13 and batten members 15 are connected to one another through hinges 30 which can be freely rotated on a plane formed along the axial direction of the structures. When they are collapsed, hinges 30 are rotated, leaving batten members 15 not twisted. Therefore, they are more advantageous from the viewpoint of construction and design.

Figure 16:
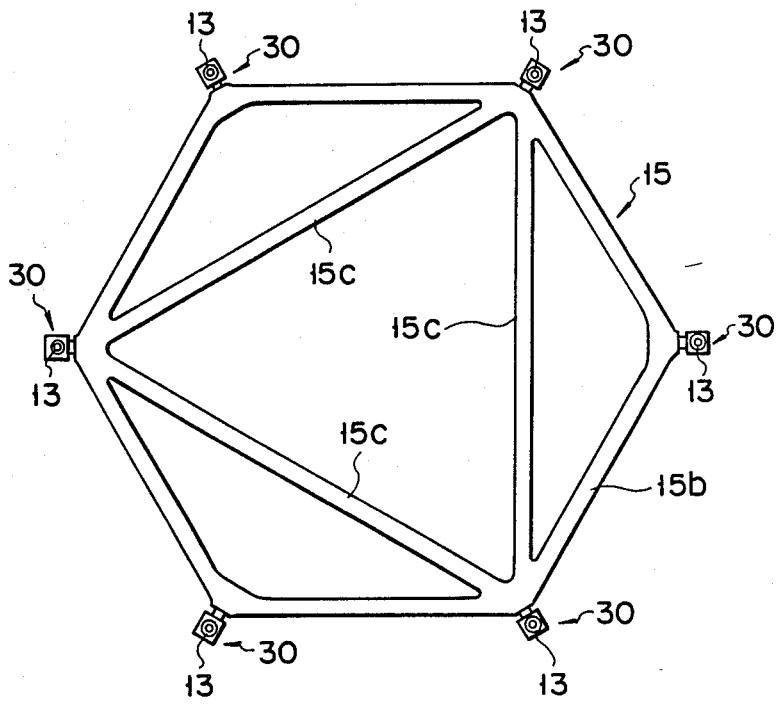
FIG. 16 is a plan view showing how longerons are connected to batten members in a tenth embodiment of the present invention.

FIG. 16 hows a tenth embodiment of the present invention. This batten member 15 has no arm but includes circumferential batten parts 15*b* and diagonal batten parts 15*c*. The stiffness of this batten member itself is higher as compared with those which have been used in the above-described embodiments and which has the arms. Longerons 13 and batten members 15 are connected to one another through hinges 30 which can be freely rotated on a plane formed along the axial direction of the structures.

The above-described embodiments are intended to make the characteristics of the present invention understood. It should be therefore understood that the present invention is not limited to these embodiments, but that various changes and modifications can be made without departing from the spirit and scope of the present invention by those skilled in the art.

What is claimed is:

1. An extensible structure comprising a pair of end plates, at least five normally straight longerons substantially parallel to each other and elongated along an axial direction, each of said longerons having both of their ends rotatably attached to respective end plates and having a characteristic such that it can be resiliently deformed to a coil-like shape, a plurality of batten members connected to the longerons and arranged at certain intervals in the axial direction to couple said longerons to one another, and two chords diagonally stretched on a plane defined by four connected points located where two of said longerons are connected to two of said plurality of batten members, wherein said two longerons have at least one longeron interposed between them along the circumference of the end plates, and said two batten members are adjacent to each other in the axial direction.

2. The extensible structure according to claim 1, wherein each of the plurality of batten members has plural twistable arms of which free ends thereof are connected to the longerons and which are twisted and deformed when the longerons are deformed so as to resemble a coil-like shape.

3. The extensible structure according to claim 1, wherein one longeron is interposed between said two longerons.

4. The extensible structure according to claim 1, wherein two longerons are interposed between said two longerons.

* * * * *

UNITED STATES PATENT AND TRADEMARK OFFICE

CERTIFICATE OF CORRECTION

PATENT NO. : 4,866,892

DATED : September 19, 1989

INVENTOR(S) : SATOH et al

It is certified that error appears in the above-identified patent and that said Letters Patent is hereby corrected as shown below:

On the title page, under "U.S. PATENT DOCUMENTS", column 2, the USP "3,482,279" should read --3,486,279--.

Signed and Sealed this

Fifteenth Day of January, 1991

*Attest:*

HARRY F. MANBECK, JR.

*Attesting Officer*

*Commissioner of Patents and Trademarks*